US007382362B2

(12) United States Patent
Chilukuri et al.

(10) Patent No.: US 7,382,362 B2
(45) Date of Patent: Jun. 3, 2008

(54) APPARATUS AND METHOD FOR PROCESSING SYNCH SIGNALS IN GRAPHIC CONTROLLERS

(75) Inventors: Ram Chilukuri, San Jose, CA (US); Lawrence A. Prather, Boulder Creek, CA (US); Ramakrishna R. Venuthurupalli, Santa Clara, CA (US)

(73) Assignee: Genesis Microchip Inc., Santa Clara, CA (US)

( * ) Notice: Subject to any disclaimer, the term of this patent is extended or adjusted under 35 U.S.C. 154(b) by 758 days.

(21) Appl. No.: 10/795,018

(22) Filed: Mar. 3, 2004

(65) Prior Publication Data

US 2005/0195176 A1 Sep. 8, 2005

(51) Int. Cl.
*G09G 5/00* (2006.01)

(52) U.S. Cl. ..... 345/204; 345/210; 345/212; 345/213

(58) Field of Classification Search ..... 345/87–101, 345/204–215
See application file for complete search history.

(56) References Cited

U.S. PATENT DOCUMENTS

| | | | | |
|---|---|---|---|---|
| 5,786,813 | A * | 7/1998 | Kurikko | 345/212 |
| 6,535,224 | B2 * | 3/2003 | Kuriyama et al. | 345/690 |
| 6,600,469 | B1 * | 7/2003 | Nukiyama et al. | 345/87 |
| 7,079,105 | B2 * | 7/2006 | Katagawa | 345/99 |
| 2002/0126139 | A1 * | 9/2002 | Kuriyama et al. | 345/690 |

* cited by examiner

*Primary Examiner*—Vijay Shankar
(74) *Attorney, Agent, or Firm*—Beyer Law Group LLP

(57) ABSTRACT

An apparatus and method for processing Hsync and Vsync signals in graphic controllers to avoid a false reading of pulses caused by glitches. The apparatus and method involve detecting when the synch signal crosses the threshold for the first time. When this occurs, the output of the detection circuit is held for the predetermined period of time, even if subsequent transitions across threshold occur during this period. After the predetermined period expires, the output is released and may assume the same state as the input sync signal at that time. In this manner, a misinterpretation of the resolution format caused by the reading of a "false" pulse caused by a glitch on a sync signal can be avoided.

29 Claims, 3 Drawing Sheets

APPARATUS AND METHOD FOR PROCESSING SYNCH SIGNALS IN GRAPHIC CONTROLLERS

FIELD OF THE INVENTION

The present invention relates generally to the display devices, and more particularly, to an apparatus and method for processing Hsync and Vsync signals in graphic controllers.

BACKGROUND OF THE INVENTION

Graphic controllers are used by computers and other graphic-intensive devices such as video game consoles for controlling the image that is displayed on an image device, such as a CRT, LCD panel, or plasma display. Generally speaking, graphic controllers are responsible for translating information received in one resolution to a second resolution that is native to the display device. For example, if the video input signals are in the standard video 640×480 pixel resolution, but the actual display device is an HDTV display resolution having 1024×784 pixels, then the graphics controller is required to upscale the input video information to the 1024×784 format used by the display device. Alternatively, the graphics controller is required to downscale the video information when the input video information has a greater resolution than the display device.

The video input information provided to a graphics controller typically includes both color information signals and timing signals. The color information signals are typically three separate signals representing the colors red, blue and green (i.e., "RGB") respectively. For each pixel, the magnitude of each signal represents the amount of red, blue and green to be displayed per pixel. When combined, the three signals are capable of generating the full color spectrum, depending on the magnitude of each color signal. The timing signals are horizontal or Hsync and vertical or Vsync. The Hsync signal defines the start time and end time for displaying a horizontal line on the display. The Vsync signal defines the start time and end time of each frame.

The graphics controller is responsible for generating the output signals, in response to the input signals, necessary to generate the desired output on the display device. These signals typically include a 24 bit RGB signal that defines the color for each pixel on the display, Hsync and Vsync signals, a data enable DE signal, and display clock CLK signal. For example, the current HDTV standard defines a pixel display having a resolution of 1024×784. Each frame therefore has 784 horizontal lines from top to bottom of the display. Each horizontal line has 1024 pixels. Each pulse of the Hsync signal represents the start of a new row. For each row, the CLK clock is pulsed 1024 times. With each pulse, a 24 bit RGB signal that defines the color for each pixel is generated. With progressive scan, the Vsync signal is pulsed after the 784 rows are displayed to designate the start of a new frame. The data enable signal DE is typically used only for raster type display devices. The DE signal is reset to disable the display during retracing or blanking. Although the data enable signal is not needed for non-raster type displays such as plasma or LCD panels, most graphic controllers retain this signal to be backwards compatible with older display devices such as standard televisions or CRTs.

Graphic controllers include a processing module to perform the translation from the input to the output resolutions. One responsibility of the processing module is to detect the resolution of the input video information. This is typically done by analyzing the timing between pulses of the input Hsync and Vsync signals. The Hsync and Vsync signals are first passed through an on-chip regenerative circuit, such as a Schmitt trigger, before being provided to the processing module. Based on the measured time duration between pulses, the processing module determines the resolution of the input video information.

Glitches in the Hsync and/or Vsync signals provided to the inputs of the graphic controller may cause the processing module to make an error in computing the wrong resolution of the input signals. For example, a sync signal may have a "shoulder" on the rising edge at a voltage level somewhere between zero volts and Vdd. Similarly, the signal may have a shoulder between Vdd and zero on the falling edge. If the shoulder occurs at or near the trigger points of the Schmitt trigger, the regenerated output of the synch signal may also contain glitches. The processing module may therefore misinterpret a glitch as a "false pulse", and as a consequence, compute the wrong resolution of the input.

An apparatus and method for processing Hsync and Vsync signals in graphic controllers to avoid a false reading of pulses caused by glitches is therefore needed.

SUMMARY OF INVENTION

To achieve the foregoing, and in accordance with the purpose of the present invention, an apparatus and method for processing Hsync and Vsync signals in graphic controllers to avoid a false reading of pulses caused by glitches is disclosed. The apparatus includes a detection circuit having a first input configured to receive a first sync signal at either a first voltage corresponding to first state or a second voltage corresponding to a second state and a first output configured to generate an output signal at either the first voltage corresponding to the first state or the second voltage corresponding to the second state. The detection circuit also includes a first holding circuit configured to hold the first output of the detection circuit at either the first voltage or the second voltage for a predetermined period of time after the first synch signal first initially crosses a threshold voltage. The first holding circuit is configured to ignore any subsequent measured transitions of the first synch signal across the threshold during the predetermined period of time. During operation, the method involves detecting when the synch signal crosses the threshold for the first time. When this occurs, the output of the detection circuit is held at the appropriate state for the predetermined period of time, even if subsequent transitions across threshold occur during this period. After the predetermined period expires, the output is released and may assume the same state as the input sync signal at that time. In this manner, a misinterpretation of the resolution format caused by the reading of a "false" pulse caused by a glitch on a sync signal can be avoided.

BRIEF DESCRIPTION OF THE DRAWINGS

The invention, together with further advantages thereof, may best be understood by reference to the following description taken in conjunction with the accompanying drawings in which.

In the figures, like reference numbers refer to like components and elements.

DETAILED DESCRIPTION OF THE INVENTION

Figure 1:
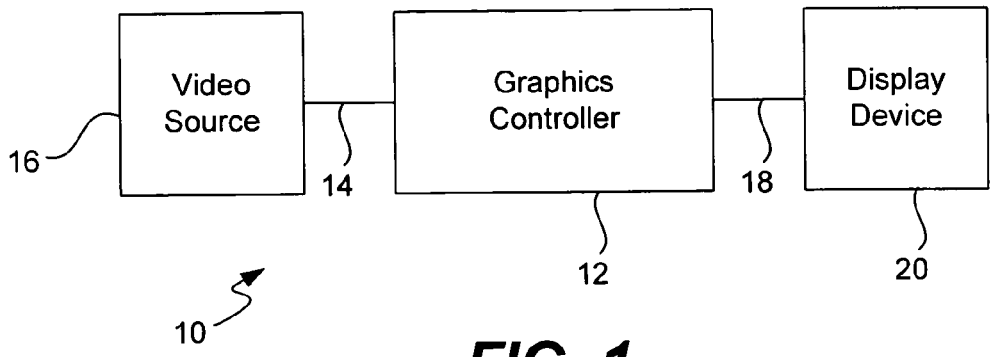
FIG. 1 is a block diagram of a video display system according to the present invention.

Referring to FIG. 1, a block diagram of a video display system according to the present invention is shown. The system 10 includes a graphics controller 12 configured to receive video input signals 14 from a video source 16 and to provide output video signals 18 to a display device 20. In various embodiments of the invention, the video input source can be any one of a number of different types, including a computer, video game console, television, or the like. Similarly, the display device 20 can also be anyone of a number of different types of display devices, such as a standard television, computer CRT display, LCD panel or a plasma display. The video input signals 14 include (but are not limited to) RGB color signals and Hsync and Vsync timing signals. The video output signals 18 include (but are not limited to) RGB color signals, Hsync and Vsync timing signals, a clock signal and a data enable DE signal.

The graphics controller 12 is responsible for translating the video signals 14 received from the video source 16 in a first resolution format into the video signals 18 in a second resolution format used by the display device 20 According to various embodiments of the invention, the resolution formats used by either the video source 16 or the display device 20 can be such formats as SMPTE 274M-1995 (1920×1080 resolution), progressive or interlaced scan, SMPTE 296M-1997 (1280×720 resolution) or standard 480 progressive scan video. In situations where the resolution of the input and output video signals 14 and 18 are different, the graphics controller is required to either upscale or downscale the video information as necessary. As previously discussed, the graphic controller determines the resolution of the input video signals 14 by detecting the timing between pulses of the Hsync and Vsync signals. On occasion, however, glitches in these signals may cause the graphics controller 12 to misinterpret a false pulse, resulting in the determination of the incorrect resolution.

Figure 2:
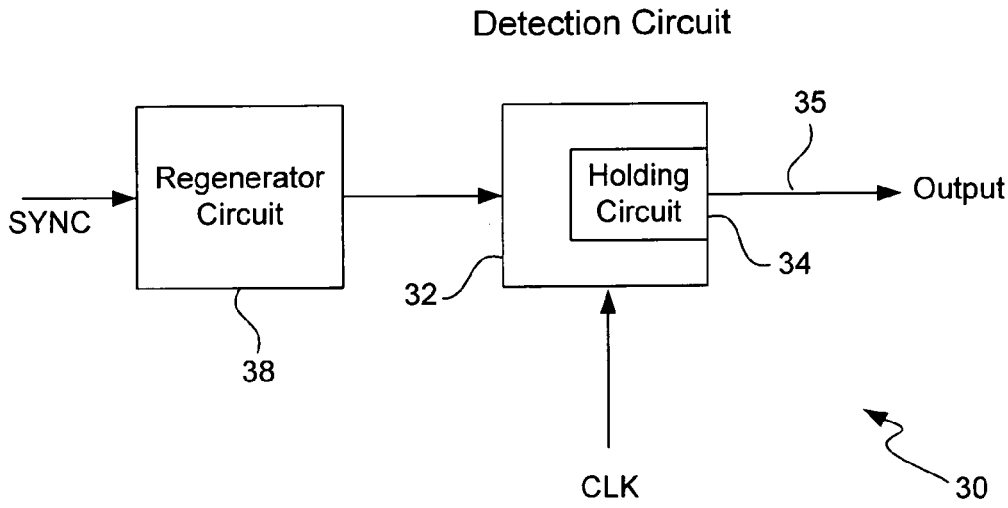
FIG. 2 is a circuit block diagram for processing sync signals to avoid a false reading of pulses caused by glitches in the video display system of the present invention.

Referring to FIG. 2, a block diagram of a circuit on the graphics controller 12 for processing sync signals to avoid a false reading of pulses caused by glitches is shown. The circuit 30 includes a detection circuit 32 including a holding circuit 34, and a regenerator circuit 38. The regenerator circuit 38 is configured to receive a synch signal (either Hsync or Vsync) and to regenerate the signal. The sync signal transitions between a first voltage corresponding to a first state and a second voltage corresponding to a second state. In one embodiment, a Schmitt trigger is used for the regenerative circuit 38. However, it should be understood that any circuit that would regenerate or "clean up" the incoming sync signal could be used.

The detection circuit 32 receives the sync signal from the regenerator circuit 38 and a clock signal CLK. The detection circuit 32 measures the voltage of the synch signal and determines when it crosses a threshold voltage. The threshold is a voltage that is set between the first voltage and the second voltage. When the measured sync signal first crosses the threshold voltage, the holding circuit 34 is configured to hold the output 35 of the detection circuit at either the first voltage corresponding to the first state or the second voltage corresponding to the second state for a predetermined period of time. The predetermined period of time is determined by counting the number of pulses of clock signal CLK. For example, if the sync signal crosses the threshold on a rising edge, then the output 35 is held at Vdd. On the contrary, if the threshold is first crossed on a falling edge, then the output 35 is held at ground. The output 35 is held at either Vdd or ground for the duration of the predetermined period of time, regardless if the sync signal subsequently transitions across the threshold during this period. In other words, the detection circuit ignores any subsequent measured transitions of the synch signal across the threshold during the predetermined period of time. After the predetermined period of time, the output 35 of the detection circuit 34 is released and will assume the same state as the input sync signal at that time. In various embodiments, the holding circuit is essentially a storage element, such as a flip flop or latch.

It should be noted that for the sake of simplicity, only one circuit 30 is illustrated. However, it should be understood that in accordance with various embodiments of the invention, a circuit 30 would be provided for each sync signal received by the graphic controller 12. For example, if a graphic controller 12 received both an Hsync and a Vsync signal, then two circuits 30 would be provided.

Referring to FIGS. 3A-3D, a series of signal diagrams illustrating the operation of the video display system of the present invention are shown.

Figure 3A:
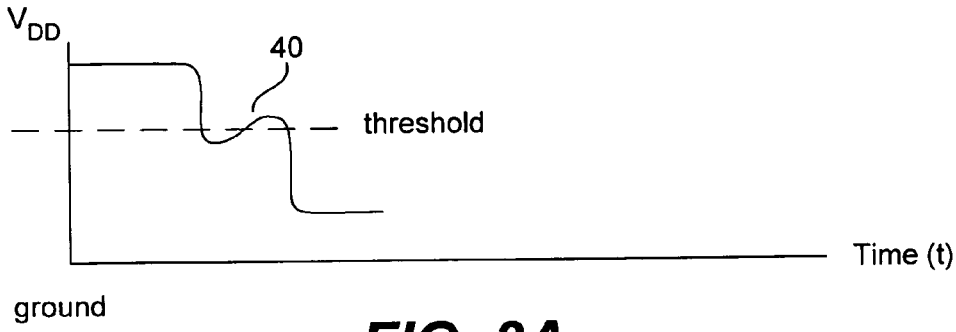
FIGS. 3A through 3D are signal diagrams illustrating the operation of the video display system of the present invention.

FIG. 3A shows the incoming sync signal transitioning from a high state (Vdd) to a low state (ground). As is often the situation, the falling edge is not clean and includes a glitch, illustrated in this example by a shoulder region designated by reference numeral 40, where the voltage initially drops below the threshold voltage and then drifts over the threshold before falling to ground.

Figure 3B:
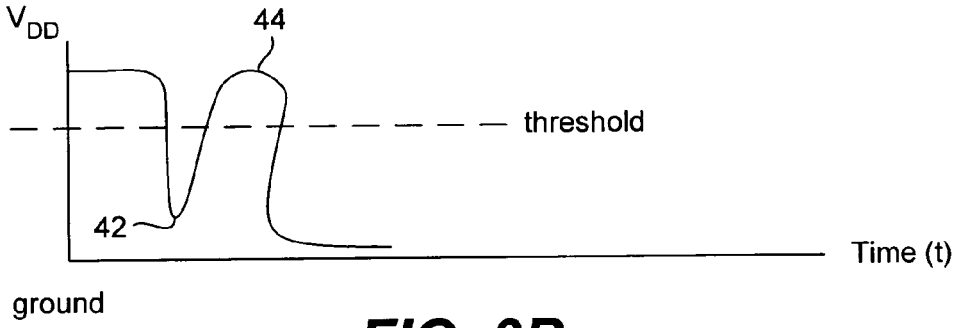

FIG. 3B illustrates the same sync signal after passing through the regenerative circuit 38. The signal includes a valley 42 corresponding to when the signal first transitioned below the threshold followed by a peak 44 where the signal transitioned above the threshold.

Figure 3C:
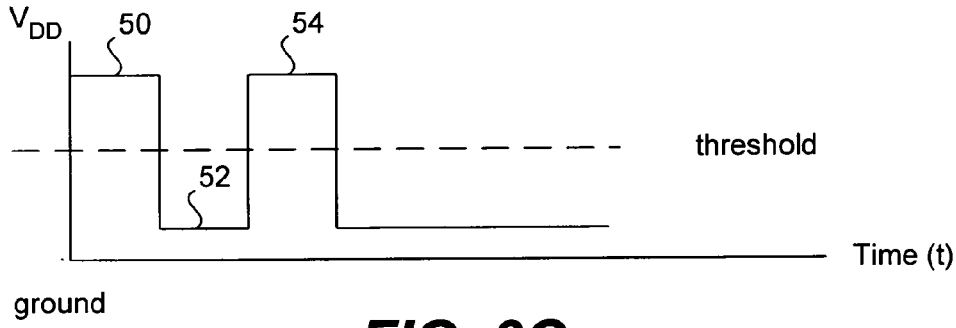

FIG. 3C illustrates a waveform that a typical detection circuit (without the present invention) may generate after receiving as an input such as the waveform of FIG. 3B. In this example, the detection circuit 32 may interpret the peak 44 (illustrated in FIG. 3B) as an actual pulse of the sync input signal. In actuality, however, it is a false pulse caused by the shoulder 40.

Figure 3D:
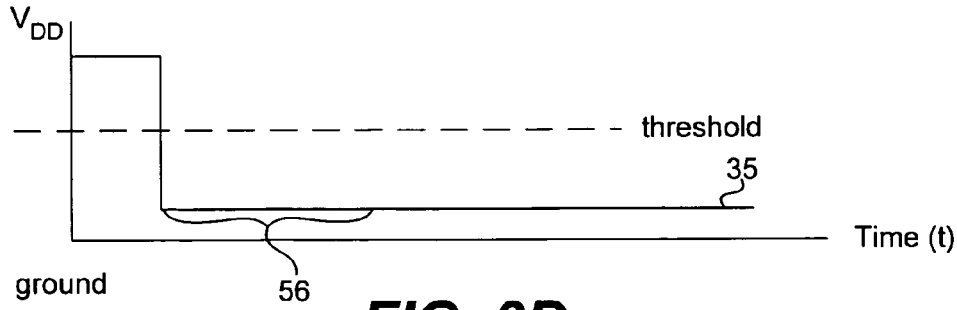

To avoid such a misinterpretation, the holding circuit 34 of the present invention is configured to hold the output at ground for the duration of a predetermined period of time after the voltage crosses the threshold for the first time. As illustrated in FIG. 3D, after the signal initially falls below the threshold, the output 35 is held at ground for a predetermined period of time, designated by reference numeral 56. The output 35 is held at ground during the predetermined period of time even if the input sync signal transitions above or below the threshold during this period. In other words, the detection circuit 32 ignores any subsequent measured transitions of the synch signal across the threshold during the predetermined period of time. After the predetermined period of time, the output 35 of the detection circuit 34 is released and will assume the same state as the input sync signal at that time.

The applicants have found that the predetermined period of time may range from 15 to 20 ns. It should be noted that this range is only exemplary and should not be used in anyway to limit the scope of the invention. Time periods of greater (e.g. 25 ns or longer) or shorter (10 ns or less) duration may be used in accordance with the present invention.

It also should be noted that the FIGS. 3A-3D illustrate the operation of the present invention upon a falling edge of the sync circuit. It should be understood that the complement of the above would occur with the occurrence of a rising edge.

Figure 4:
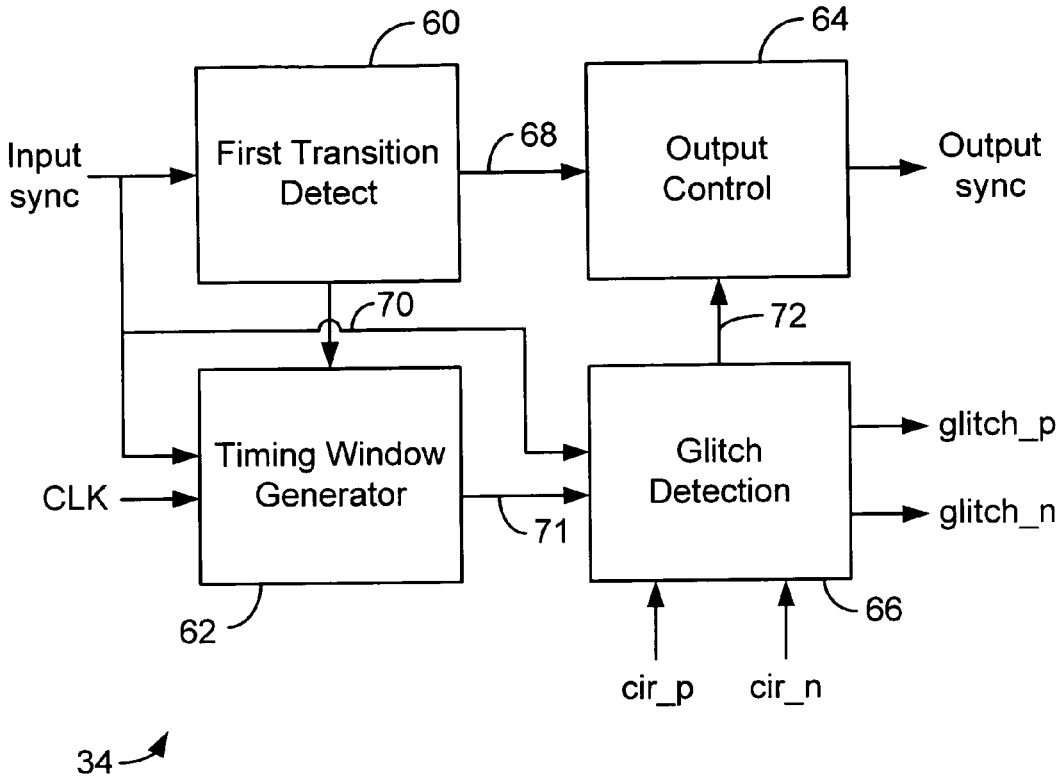
FIG. 4 is a block diagram of a holding circuit used in video display system of the present invention.

Referring to FIG. 4, a block diagram of a holding circuit 34 is shown. The holding circuit 34 includes a first transition detection circuit 60, a time window generator circuit 62, an output control circuit 64, and glitch detection circuit 66.

The first transition detection circuit 60 is configured to receive the input sync signal from the regenerator circuit 38. The timing window generator circuit 62 is configured to receive both the input sync signal and the clock signal CLK. When the transition circuit 60 detects the first transition of the sync signal across the threshold, a first detection signal 68 is provided to the output control circuit 64. The output control circuit 64 holds the output sync signal at either Vdd (if the input sync signal crosses the threshold on the rising edge) or ground (if the input sync signal crosses the threshold on the falling edge). The transition detection circuit 60 also provides a second detection signal 70 to the timing window generator 62. In response, the timing window generator circuit begins to count the number of pulses of clock signal CLK until the predetermined period of time expires. When this occurs, a first release signal 71 is generated by the timing window generator 62 and is provided to the glitch detection circuit 66. In response, the glitch detection circuit 66 provides a second release signal 72 to the output control circuit 64. When the second release signal 72 is received, the output control circuit 64 releases the output sync signal so that it can assume the same state as the input sync signal after the predetermined period of time after the first transition has lapsed.

The glitch detection circuit 66 also provides a feedback mechanism that allows the trigger point of the regenerator circuit 38 (e.g., a Schmitt trigger) to be adjusted. The glitch detection circuit 66 receives the input sync signal and the first release signal 71. If a shoulder occurs on the input sync signal during the timing window period, one of the outputs, either "glitch_p" or "glitch_n" is set as a flag to indicate that a glitch has occurred on the sync signal. For example, if a positive rising shoulder occurs on the falling edge of the input sync signal, then the flag glitch_p is set. Alternatively, the glitch_n signal is set if a negative shoulder occurs during the rising edge of the input sync signal. In response to either flag being set, the threshold of the regeneration circuit can be adjusted so that the trigger point is no longer near the voltage where the shoulder occurred.

Although the foregoing invention has been described in some detail for purposes of clarity of understanding, it will be apparent that certain changes and modifications may be practiced within the scope of the appended claims. Therefore, the described embodiments should be taken as illustrative and not restrictive, and the invention should not be limited to the details given herein but should be defined by the following claims and their full scope of equivalents.

We claim:

1. An apparatus, comprising:

a detection circuit having:

a first input configured to receive a first synch signal at either a first voltage corresponding to first state or a second voltage corresponding to a second state, a first output configured to generate an output signal at either the first voltage corresponding to the first state or the second voltage corresponding to the second state, a first holding circuit configured to hold the first output of the detection circuit at either the first voltage or the second voltage for a predetermined period of time after the first synch signal initially crosses a threshold voltage, the first holding circuit ignoring any subsequent measured transitions of the first synch signal across the threshold voltage during the predetermined period of time;

a second input configured to receive a second synch signal at either a first voltage corresponding to first state or a second voltage corresponding to a second state, a second output configured to generate a second output signal at either the first voltage corresponding to the first state or the second voltage corresponding to the second state, and a second holding circuit configured to hold the second output of the detection circuit at either the first voltage or the second voltage for the predetermined period of time after the second synch signal first crosses a second threshold voltage, the second holding circuit ignoring any subsequent measured transitions of the second synch signal across the second threshold voltage during the predetermined period of time.

2. The apparatus of claim 1, wherein the predetermined period of time is less than 25 ns.

3. The apparatus of claim 1, wherein the predetermined period of time is greater than 10 ns.

4. The apparatus of claim 1, wherein the first sync signal is an Hsync signal.

5. The apparatus of claim 1, wherein the second sync signal is a Vsync signal.

6. The apparatus of claim 1, wherein the holding circuit further comprises a memory element configured to hold the first output of the detection circuit at either the first voltage or the second voltage for the predetermined period of time after the first synch signal first crosses the threshold voltage.

7. The apparatus of claim 6, wherein the memory element comprises but is not limited to one of the following types of memory elements: a flip-flop, or a latch.

8. The apparatus of 6, further comprising a timing generator circuit coupled to the memory element, the timing generator circuit configured to provide a release signal to the memory element to cause the memory element to release the output of the detection circuit after the predetermined period of time has lapsed.

9. The apparatus of claim 8, wherein the timing generator circuit is coupled to a pulsed clock signal having a predetermined frequency, the timing generator circuit being configured to generate the release signal after the receiving a number of clock pulses that exceeds the predetermined period of time.

10. The apparatus of claim 1, wherein the detection circuit is included on a graphics controller, the graphics controller further configured to receive video signals in one resolution and to translate them to a second resolution for display on a display device.

11. The apparatus of claim 10, wherein the graphics controller is further configured to receive the video signals in the one resolution, the video signals including red, blue and green color signals, the first synch signal, and a second synch signal.

12. The apparatus of claim 11, wherein the video signals in the first resolution are generated by a video output device.

13. The apparatus of claim 10, wherein the display device comprises but is not limited to one of the following types of display devices: a CRT, plasma screen, a projector display, or a LCD panel.

14. The apparatus of claim 13, wherein the holding circuit is further configured to either:

release the output of the detection circuit at the first voltage corresponding to the first state if the sync signal is at the first voltage after the predetermined period of time has lapsed; or release the output of the detection circuit at the second voltage corresponding to the second state if the sync signal is at the second voltage after the predetermined period of time has lapsed.

15. The apparatus of claim 1, further comprising a regenerative circuit, coupled to the detection circuit, and configured to regenerate the sync signal before it is provided to the detection circuit.

16. An apparatus, comprising;

means for receiving a sync signal that transitions between a first voltage corresponding to a first state and a second voltage corresponding to a second state at a detection circuit;

means for detecting at the detection circuit when the measured synch signal transitions a threshold voltage, the threshold voltage between the first voltage and the second voltage;

means for holding an output of the detection circuit at either the first voltage or the second voltage for a predetermined period of time after the measured synch signal first crosses the threshold voltage, the detection circuit ignoring any subsequent measured transitions of the synch signal across the threshold voltage during the predetermined period of time;

means for releasing the output of the detection circuit after the predetermined period of time;

means for releasing the output of the detection circuit at the first voltage corresponding to the first state if the sync signal is at the first voltage after the predetermined period of time has lapsed; or means for releasing the output of the detection circuit at the second voltage corresponding to the second state if the sync signal is at the second voltage after the predetermined period of time has lapsed.

17. The apparatus of claim 16, wherein the sync signal is an Hsync signal.

18. The apparatus of claim 16, wherein the sync signal is a Vsync signal.

19. The apparatus of claim 16, wherein the predetermined period of time is greater than 10 ns.

20. The apparatus of claim 16, wherein the predetermined period of time is less than 25 ns.

21. The apparatus of claim 16, further comprising:

means for holding the output of the detection circuit at the first voltage corresponding to the first state when the first transition of the sync signal across the threshold is in a first direction; or means for holding the output of the detection circuit at the second voltage corresponding to the second state when the first transition of the sync signal across the threshold is in a second direction.

22. The apparatus of claim 16, further comprising deriving the predetermined period of time by counting the number of cycles of a clock signal.

23. A method, comprising;

receiving a sync signal that transitions between a first voltage corresponding to a first state and a second voltage corresponding to a second state at a detection circuit;

detecting at the detection circuit when the measured synch signal transitions a threshold voltage, the threshold voltage between the first voltage and the second voltage;

holding an output of the detection circuit at either the first voltage or the second voltage for a predetermined period of time after the measured synch signal first crosses the threshold voltage, the detection circuit ignoring any subsequent measured transitions of the synch signal across the threshold voltage during the predetermined period of time;

releasing the output of the detection circuit after the predetermined period of times;

releasing the output of the detection circuit at the first voltage corresponding to the first state if the sync signal is at the first voltage after the predetermined period of time has lapsed; or releasing the output of the detection circuit at the second voltage corresponding to the second state if the sync signal is at the second voltage after the predetermined period of time has lapsed.

24. The method of claim 23, wherein the sync signal is an Hsync signal.

25. The method of claim 23, wherein the sync signal is a Vsync signal.

26. The method of claim 23, wherein the predetermined period of time is greater than 10 ns.

27. The method of claim 23, wherein the predetermined period of time is less than 25 ns.

28. The method of claim 23, further comprising:

holding the output of the detection circuit at the first voltage corresponding to the first state when the first transition of the sync signal across the threshold is in a first direction; or holding the output of the detection circuit at the second voltage corresponding to the second state when the first transition of the sync signal across the threshold is in a second direction.

29. The method of claim 23, further comprising deriving the predetermined period of time by counting the number of cycles of a clock signal.

* * * * *